US006619101B1

(12) United States Patent
Faucher et al.

(10) Patent No.: US 6,619,101 B1
(45) Date of Patent: Sep. 16, 2003

(54) CRIMPING TOOL HEAD WITH REINFORCING BEAMS FOR OPTIMIZING WEIGHT

(75) Inventors: Thomas Faucher, Manchester, NH (US); Gordon L. Stelzer, Goffstown, NH (US); Christopher G. Chadbourne, Nashua, NH (US); John D. LeFavour, Litchfield, NH (US); Alexander Shlopak, Bethlehem, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/126,392

(22) Filed: Apr. 19, 2002

(51) Int. Cl.[7] ..... B21D 37/10

(52) U.S. Cl. ..... 72/456; 72/453.15; 72/453.16; 72/416

(58) Field of Search ..... 72/453.15, 453.16, 72/455, 456, 416; 100/231

(56) References Cited

U.S. PATENT DOCUMENTS 686,352 A * 11/1901 Sellers et al. ..... 72/453.15
905,109 A * 11/1908 Sears ..... 72/453.15
2,869,407 A * 1/1959 Swanson ..... 72/453.16
3,017,905 A * 1/1962 Klein ..... 72/453.16
3,057,233 A * 10/1962 Turner ..... 72/416
3,326,029 A * 6/1967 Porter ..... 72/453.16
3,554,000 A * 1/1971 Schwab ..... 72/453.15
4,055,980 A * 11/1977 Churla ..... 72/416
4,226,110 A * 10/1980 Suganuma ..... 72/416
4,292,833 A * 10/1981 Lapp ..... 72/453.16
4,366,673 A * 1/1983 Lapp ..... 60/477
5,062,290 A * 11/1991 Hoover ..... 72/453.16
5,111,681 A * 5/1992 Yasui et al. ..... 72/453.16
5,343,728 A * 9/1994 Chubb et al. ..... 72/319
5,727,417 A * 3/1998 Moffatt et al. ..... 72/453.03
5,778,755 A * 7/1998 Boese ..... 91/399
5,924,536 A * 7/1999 Frenken ..... 192/56.1
5,934,136 A * 8/1999 Bracher et al. ..... 72/402
6,044,681 A * 4/2000 Frenken ..... 72/402
6,085,422 A * 7/2000 Hirabayashi ..... 30/122
6,227,030 B1 * 5/2001 Lefavour et al. ..... 72/416
6,230,542 B1 * 5/2001 Frenken ..... 72/456

* cited by examiner

*Primary Examiner*—David B. Jones
(74) *Attorney, Agent, or Firm*—Harrington & Smith, LLP

(57) ABSTRACT

A head for a crimping tool assembly comprises a generally "C" shaped body which can withstand repeated tensile forces. The "C" shaped body comprises an elongated beam portion and a first arm extending in a given direction from a first end of the beam portion and a second arm extending in the given direction from an opposing end of the beam portion. The beam portion has opposed first and second elongated sides, with the plane of the first and second sides extending generally parallel to the given direction. The beam portion also has an inside elongated third side extending transversely of the given direction between the first and second sides. The beam portion further includes an outside elongated fourth side extending transversely of the given direction between the first and second sides. The third and fourth sides of the beam comprise continuous walls of a given thickness. The beam portion has a plurality of internal support ribs which extend between the first and second sides transversely of the given direction. The ribs are connected at one end to the third side wall and at their opposing end to the fourth side wall. The beam portion also has a plurality of openings or depressions in the first and second sides for reducing the weight of the beam portion, the openings or depressions are disposed in lower stress regions of the beam portion.

23 Claims, 6 Drawing Sheets

CRIMPING TOOL HEAD WITH REINFORCING BEAMS FOR OPTIMIZING WEIGHT

CROSS REFERENCE TO A RELATED APPLICATION

U.S. application Ser. No. 10/125,908 entitled "Hydraulic Crimping Tool," filed of even date herewith.

BACKGROUND OF THE INVENTION

1. Field of the Invention

The present invention relates to a crimping tool head with reinforcing beams providing reduced weight and improved weight distribution.

2. Brief Description of Earlier Developments

U.S. Pat. Nos.: 4,292,833 to Lapp et al., 4,366,673 to Lapp, 5,111,681 to Yasui et al., 5,727,417 to Moffatt et al., 5,778,755 to Boese, 5,924,536 to Frenken, 5,934,136 to Bracher et al., 6,044,681 to Frenken, and 6,230,542 to Frenken are illustrative of prior crimp tools and crimp heads. These patents are intended to be incorporated by reference herein in their entireties.

U.S. Patent Nos.: 4,226,110 to Suganuma, 6,085,422 to Hirabayashi, Des. 408,242 to Yamamoto and Japanese Patent Publication No. 11-251030 are illustrative of prior crimp tools and crimp heads wherein the crimp heads have at least one depressed portion to make them lighter. These patents and publications are intended to be incorporated by reference herein in their entireties.

SUMMARY OF THE INVENTION

In accordance with an embodiment of the invention a head for a crimping tool assembly comprises a generally "C" shaped body which can withstand repeated tensile forces. The "C" shaped body comprises an elongated beam portion and a first arm extending in a given direction from a first end of the beam portion and a second arm extending in the given direction from an opposing end of the beam portion. The beam portion has opposed first and second elongated sides, with the plane of the first and second sides extending generally parallel to the given direction. The beam portion also has an inside elongated third side extending transversely of the given direction between the first and second sides. The beam portion further includes an outside elongated fourth side extending transversely of the given direction between the first and second sides. The third and fourth sides of the beam comprise walls or rails of a given thickness;

In accordance with this invention the beam portion has a plurality of internal support ribs which extend between the first and second sides transversely of the given direction. The ribs are connected at one end to the third side wall and at their opposing end to the fourth side wall. The ribs are connected at the third side wall at higher stress regions of the beam portion. The beam portion has a plurality of openings or depressions in the first and second sides for reducing the weight of the beam portion. The openings or depressions are disposed in lower stress regions of the beam portion.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
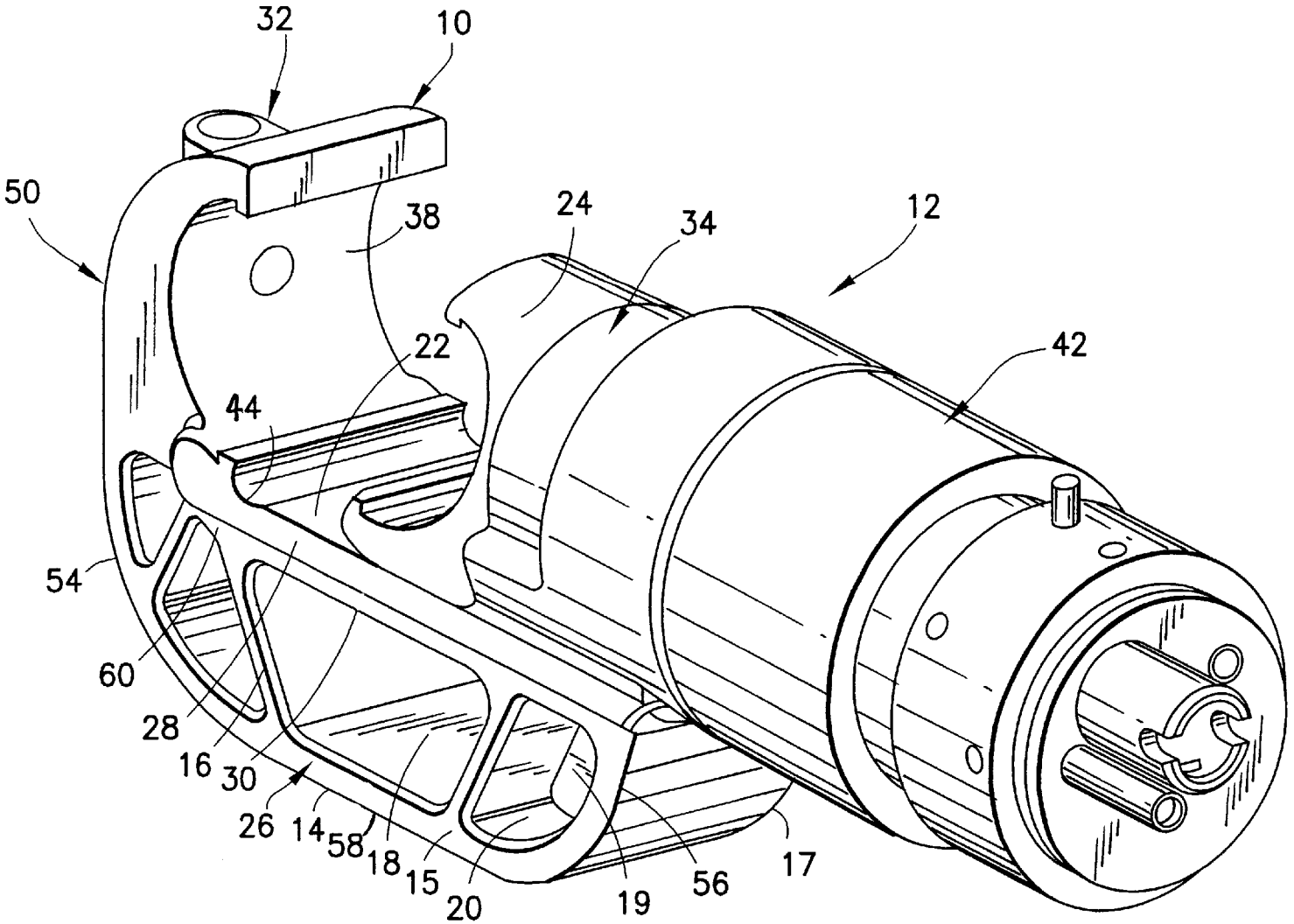
FIG. 1 is a perspective view of a crimping tool having a crimping head in accordance with an embodiment of the invention.

Although the present invention will be described with reference to the embodiments shown in the drawings, it should be understood that the present invention can be embodied in many alternate forms of embodiments. In addition, any suitable size, shape or type of elements or materials could be used. Corresponding elements have been given the same reference numbers.

This invention is concerned with a crimp head 10 as exemplified in FIGS. 1–5, which is primarily used in hydraulic crimping tool 12 assemblies. The head 10 can be used with crimp dies, cutter dies, punching dies, and the like, for performing various operations which are necessary for the termination of electrical connections or other various operations conducted by utility, manufacturing, or construction personnel.

The embodiments of the invention which are shown in the FIGS. are designed in such a way that they provide significant advantages over the earlier developments set forth in the Background above. The head 10 consists of a body 14 which is composed of a suitable structural material, such as for example steel or any other desired material. It is preferably formed by forging but it could be formed by any desired technique, including without limitation, investment die casting, machining, thixoforging, etc. Electric spark machining is one of many well known machining techniques which could be used.

In accordance with this invention in order to provide improved ergonomic qualities to the crimp tool 12, it is desirable to manufacture the tool 12 in such a way that as much weight as possible is removed from each of the components without sacrificing their design intent or safe, long-term use of the tool 12. One way to remove weight is to use a material which has a lesser density than the materials commonly used for such purposes such as forged steel. However, most materials which have a lower density are either cost-prohibitive, do not have the proper mechanical properties, or are unable to be cost-effectively manufactured. One of the most critical areas where reducing the weight of the tool 12 must be taken into account and where the most gain can be realized due to its size is the crimp head 10. In many instances such as manually operated hydraulic tools 12 the crimp head 10 is the furthest distance away from the user's hands, and therefore, its weight can result in an uneven weight distribution resulting in operator discomfort if used for long periods of time.

In accordance with this invention it is desired to provide a crimp head 10 that: can withstand repeated tensile forces (for example, and without intending to be limited thereby, 24,000 lbs.); has reduced weight; is able to be used for thousands of crimp cycles; and provides a long operational life. This invention seeks to remove material where it is not needed and it is particularly unique in that it employs structural reinforcements comprising ribs or beams 16 to support high stress regions of the head 10, and removes significant amounts of material forming openings 18 or depressions 20 in lower stressed areas. This results in an extremely lightweight, portable, and functional tool 12. The head 10 also contains a flat-faced guide surface 22 to prevent rotational movement of a corresponding die holder 24. This feature results in a properly aligned die set (not shown) that maintains its alignment during the crimping process, without the use of cost-prohibitive slots, guide bars, or keying mechanisms as employed in other designs. Any desired die set could be employed.

The 'beam' portion 26 of the head 10 is the area of the head 10 that sees a majority of the tensile and compressive forces associated with the crimping process. The beam portion 26 of the head 10 contains a number of supporting ribs 16 that are strategically located where the highest stresses occur. The ribs 16 are located at the regions of the "C" shaped head 10 which will see the highest stresses. The ribs 16 engage the side wall 30 of the beam 26 and connect thereto at the high stress regions. Further, where lower stresses are present, the head contains a number of openings 18 or depressions 20 that remove material (therefore weight) from the tool 12 where it is not needed. One or more of the areas with removed material could penetrate the entire thickness of the head 10, resulting in 'holes' or openings 18 in the beam portion 26 of the tool 12. The user can employ to his or her benefit such openings 18 for holding onto the crimp head 10 during transport or for a location from which to hang the tool 12 when not in use.

The head may also preferably contain side flanges 28 that are adjacent to the side wall 30 which supports the flat-faced guide surface 22. These side flanges provide extra support for the upper section of the crimp head 10, which sees the highest tensile stress during operation. The width of the side flanges 28 is generally greater than that of the remainder of the side wall 30 of the beam portion 26. Also shown is one of many possible configurations 32 for insertion of a die release button (not shown), which is used to house a push-button/spring assembly to hold and remove crimp dies from the head 10 of the tool 12.

The head 10 may also preferably have a bearing portion 34, which is designed to provide axial rigidity for the actuator 42 which may be of any desired design as described in the earlier developments noted above.

The head 10 may also preferably contain a number of relief surfaces or pockets 44 which are machined or created by other means in order to allow the crimp dies (not shown) to fit acceptably within the die holders 24,38, of the tool 12 without requiring substantial and costly machining of the die holders 24,38. They also allow adequate surface area for the butting surfaces of the movable die holder 24 and the stationary die holder 38 to mate at the completion of the crimping operation.

Referring again to FIGS. 1–3 there is shown an embodiment of the invention which will be described in greater detail. A head 10 for a crimping tool assembly 12, comprises a generally "C" shaped body 14 which can withstand repeated tensile forces. The "C" shaped body comprises an elongated beam portion 26 and a first arm 50 extending in a given direction as shown by arrow 52 in FIG. 2 from a first end 54 of the beam portion 26. A second arm 34 comprising the bearing portion extends in the given direction 52 from an opposing end 56 of the beam portion 26. The beam portion 26 has opposed first 15 and second 17 elongated sides, with the planes of the first and second sides 15 and 17 extending generally parallel to the given direction 52. The beam portion includes an inside elongated third side 30 extending transversely of the given direction 52 connected between the first and second sides 15 and 17. The beam portion 26 further includes an outside elongated fourth side 58 extending transversely of the given direction 52 and connected between the first and second sides 15 and 17.

The third and fourth sides 30 and 58 of the beam 26 comprise continuous walls of a given thickness, which is selected as desired to provide adequate strength in the beam portion 26.

In accordance with a particularly preferred aspect of the present invention, the beam portion 26 has a plurality of internal supporting ribs 16 which extend between the first and second sides 15 and 17 transversely of the given direction 52. The ribs 16 are connected at one end to the third side wall 30 and at their opposing end to the fourth side wall 58. The ribs 16 are pointed at the third side wall 30 so they connect to higher stress regions of the beam portion. In the embodiment shown there are three ribs 16. At least two ribs 16 toward the front end 54 of the beam portion 26 form a "V" shaped configuration, with the vertex 60 of the configuration ending at the third side wall 30 at a region of particularly high stress. These ribs 16 point or converge on the high stress region. The vertex 60 of the rib configuration is arranged adjacent the first arm 50 of the body 14 and another rib 16 is shown arranged canted toward the second arm 34 and joins the third side wall 30 adjacent the second arm 34.

The beam portion 26 has a plurality of openings 18 or depressions 20 in the first and second sides 15 and 17 for reducing the weight of the beam portion. The openings 18 or depressions 20 are disposed in oil lower stress regions of the beam portion 26. Preferably at least one of the openings 18 or depressions 20 may be arranged between the adjacent ribs 16 which make up the above "V" shaped configuration. The openings 18 generally extend through the thickness of the beam portion 26 from the first side 15 to the second side 17. The depressions 20 do not extend through the thickness of the beam portion 26. The depressions 20 in each side 15, 17 of the body 14 are separated from each other by a generally central web or wall 19. The depressions 20 in each side 15, 17 preferably correspond or are complementary to each other in size and shape, however, any desired shape and size could be employed and they do not have to correspond to each other. The web or wall 19 in conjunction with the side walls 30 and 58 provide an "I" beam configuration which adds strength while reducing weight.

Figure 4:
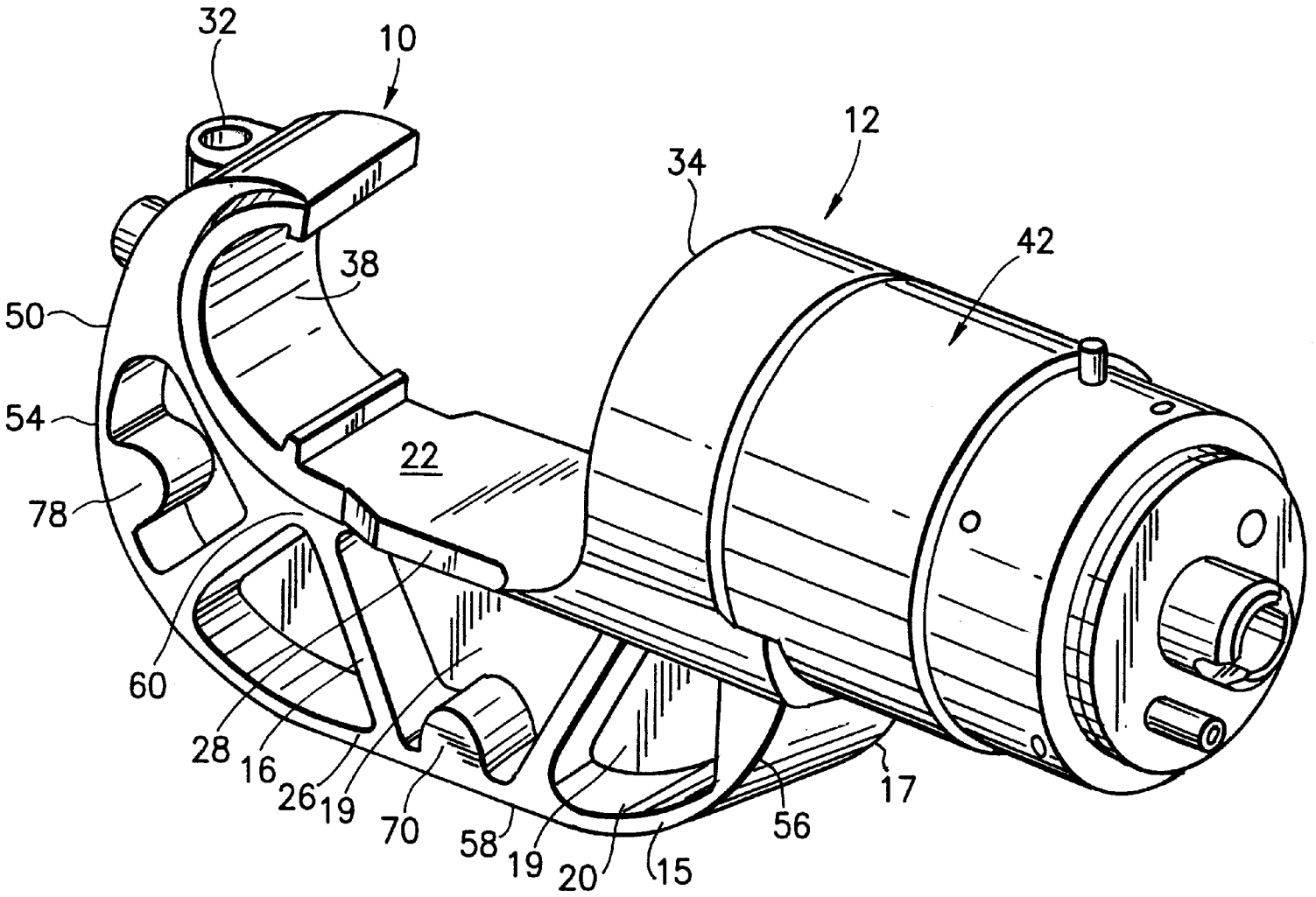
FIG. 4 is a perspective view of a crimping tool having a crimping head in accordance with an alternative embodiment of the invention.
Figure 5:
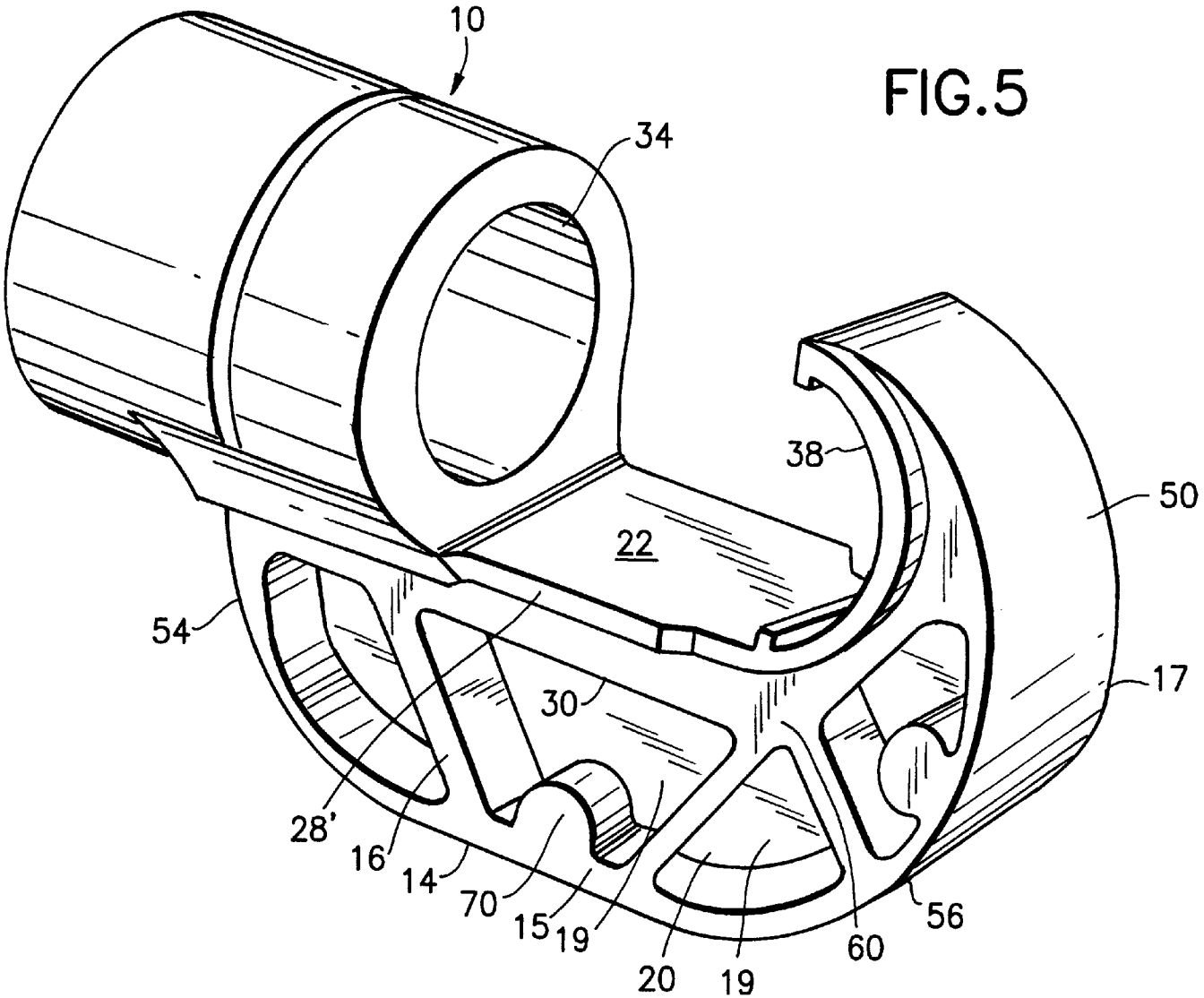
FIG. 5 is a perspective view from the opposing side of the crimping head body shown in FIG. 4.

The third side wall 30 of the beam portion 26 may include a flat-faced guide surface 22 for preventing rotational movement of the movable die holder 24 of the tool assembly 12. The beam portion 26 has side flanges 28 extending from each of the first and second sides 15 and 17. The flanges 28 can be located immediately adjacent to the flat-faced guide surface 22 and can provide an extension thereof. The flanges 28 increase at least locally the width of the flat-faced guide surface and therefore aid in strengthening the beam portion 26 for preventing the undesired rotational movement of the die holder 24. The length of the side flanges 28 may selected as desired so they extend over a majority of the length of the beam portion 26 as shown or they may be present in a more limited way as shown in FIGS. 4 and 5 for adding strength generally in a high stress region.

The external fourth side wall 58 of the beam portion 26 of the body 14 preferably curves toward each of the arms 34 and 50 to reduce stress concentrations. The central part of the beam portion 26 of the body 14 is essentially straight in this example and the end portions 54 and 56 of the beam 26 smoothly curve into the first and second arms 34 and 50 The first arm 50 preferably curves toward the second arm 34 and acts as the fixed die holder 38. The second arm 50 comprises a cylindrical bearing portion 34 which is adapted to provide axial rigidity for a ram 36 and movable die holder 24 shown in FIG. 2. The bearing portion 34 is preferably designed in conjunction with the flat-faced guide surface 22 so that the die holder 24 does not bend or rotate during crimping operations. The threaded end 40 of the bearing portion 34 of the body 14 may be attached to any desired hydraulic pump actuator portion 42 of the tool 12. The actuator 42 is preferably hydraulic and may be operated by hand or a batter or other means as desired.

Figure 2:
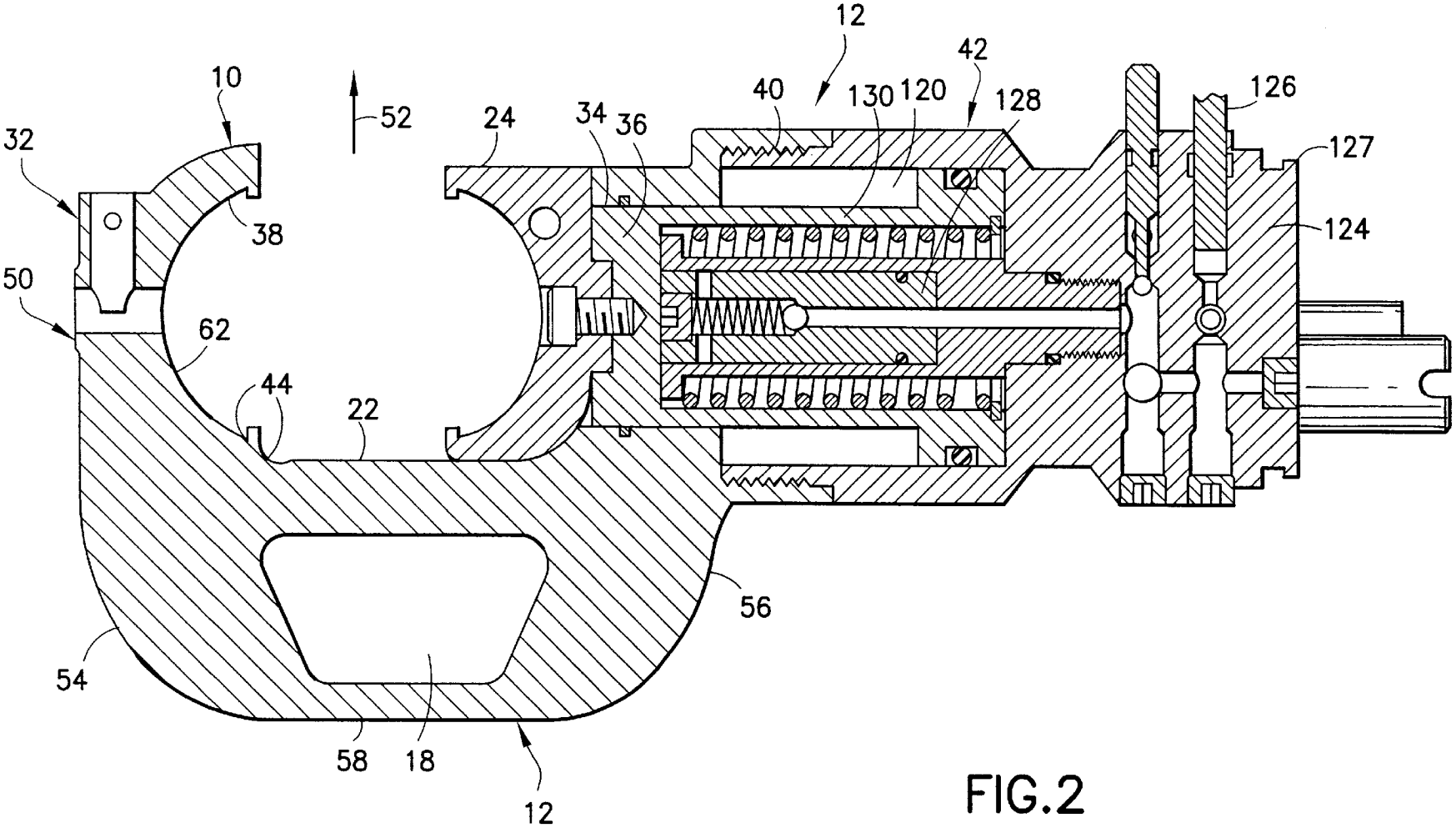
FIG. 2 is a side cross-sectional view of the crimping tool of FIG. 1.
Figure 3:
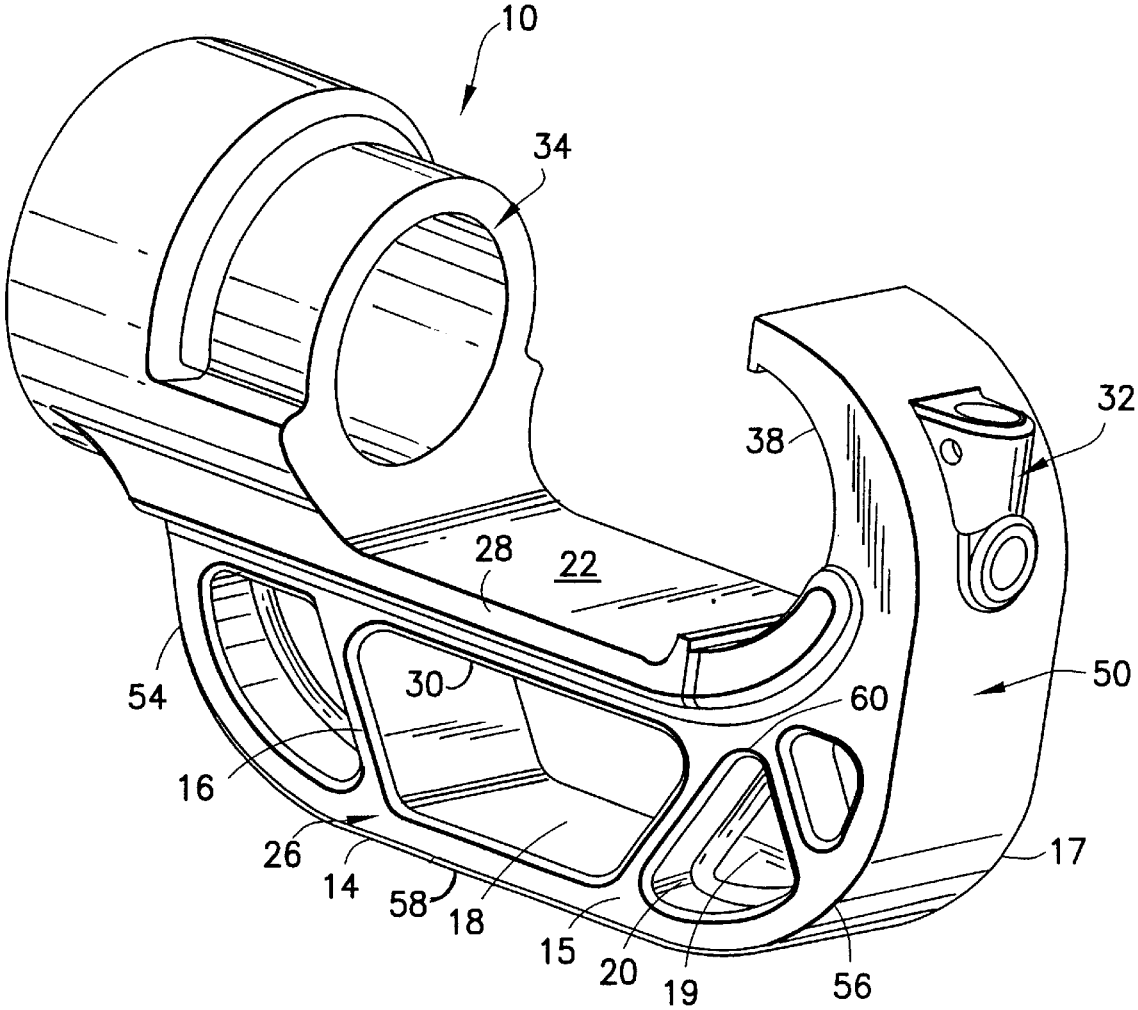
FIG. 3 is a perspective view from the opposing side of the crimping head body shown in FIG. 1.

Referring also to FIG. 2, which shows a cross-sectional elevation view of the hydraulic crimping tool 12, the tool generally comprises a head section 10, a power section 42 and a handle (not shown). The head 10 is connected to the power section 42. The handle section extends from the power section. The head 10 generally has a static die holder or adapter 38 and movable die holder or adapter 24. The die holder or anvil adapter 38 is located at one end of the head section 10. The movable die holder or adapter 24 is movably seated in the head section 10. The power section 42 is a hydraulic power section which generally has a hydraulic cylinder 120, a ram assembly 36, and a pump body 124. The ram assembly 36 is located in the cylinder 120 and is connected to the movable die holder or adapter 24 in the head section 10. The ram assembly 22 has an outer ram 130 and a ram actuator 128. The pump body 124 is connected to the hydraulic cylinder 120. The power section 42 has a pump 126 located in the pump body for pumping hydraulic fluid through the pump body into the hydraulic cylinder. The handle may include a reservoir 127 for hydraulic fluid used in the power section. The handle section may include an actuator (not shown) for actuating the pump 126 in the power unit. The actuator may be manually operated such as by using a lever incorporated into the handle. Otherwise, the actuator may be powered by a suitable motor, such as for example, an electromechanical motor. A suitable example of an electromechanical motor and linkage for operating the hydraulic tool pump is provided in U.S. patent application Ser. No. 10/119,456, filed on Apr. 9, 2002 which is incorporated by reference herein in its entirety. When the pump 126 is operated, hydraulic fluid from reservoir 127 is pumped through conduit system 124 to the hydraulic cylinder 120 and the ram assembly 36 therein. The ram actuator 128 of ram assembly 36 is pressed by hydraulic fluid against outer ram 36 thereby advancing the outer ram. The movable die holder or adapter 24 connected to the outer ram 36 of the assembly encounters resistance such as from a work piece between the anvil die holder 38 and movable die holder 24, hydraulic fluid is sent through the ram actuator 128 to the outer ram 36 thereby again advancing the outer ram and the movable die holder 24 towards the anvil die holder 38. The movable die holder 24 is guided along a guide surface 22 of head section 10 which prevents the movable die holder 24 from spinning under non-axial loads. The outer ram 36 is seated against a bearing surface 34 of head section encounters resistance such as from a work piece between the anvil die holder 38 and movable die holder 24, hydraulic fluid is sent through the ram actuator 128 to the outer ram 36 thereby again advancing the outer ram and the movable die holder 24 towards the anvil die holder 38. U.S. application Ser. No. 10/125,908, filed of even date herewith discloses further details of the actuator 42 shown in FIG. 2 and this application is specifically incorporated by reference herein in its entirety as a preferred actuator for use with the head 10 of this invention.

Relief surfaces 44 are provided in the flat-faced guide surface 22 and the internal surface 62 of the first arm 50 to allow the crimp dies (not shown) to fit without interference from the head 10. A die release button opening 32 may be provided in the first arm 50 of the body 14.

Referring now to FIGS. 4 and 5 another embodiment of the invention will be described. This embodiment is similar in many respects to the previous embodiment and like elements will be given corresponding reference numbers. In this embodiment there are no openings 18 only wells or depressions 20. Therefore a web wall 19 is present connected between walls 30 and 58 providing an "I" beam like structure over the full length of the beam portion 26. In the previous embodiment there was a mixture of openings 18 and depressions 20. Alternatively, there could be only openings 18 with no depressions 20. The all depression approach of this embodiment is particularly suited to a forged head 10. A head with all openings 18 or a mixture of openings 18 and depressions 20 may require machining or a combination of forging and machining. The side flanges 28' in this embodiment are arranged so that they widen the guide surface 22 over a localized region where the movable die holder 24 travels. This provides a lighter head since less material is used. The beam portion 26 in this embodiment includes at least one projection 70 extending from the forth side wall, the at least one projection 70 extends toward the third side wall 30 and is arranged in at least one of the openings 18 or depressions 20. Preferably a plurality of such projections 70 are present. The at least one projection provides a clamping surface for holding the body 14 during its manufacture such as during machining. Preferably there are at least two projections 70 in the beam portion 26 of the body 14. The projections 70 may have a semicylindrical shape as shown.

Figure 6:
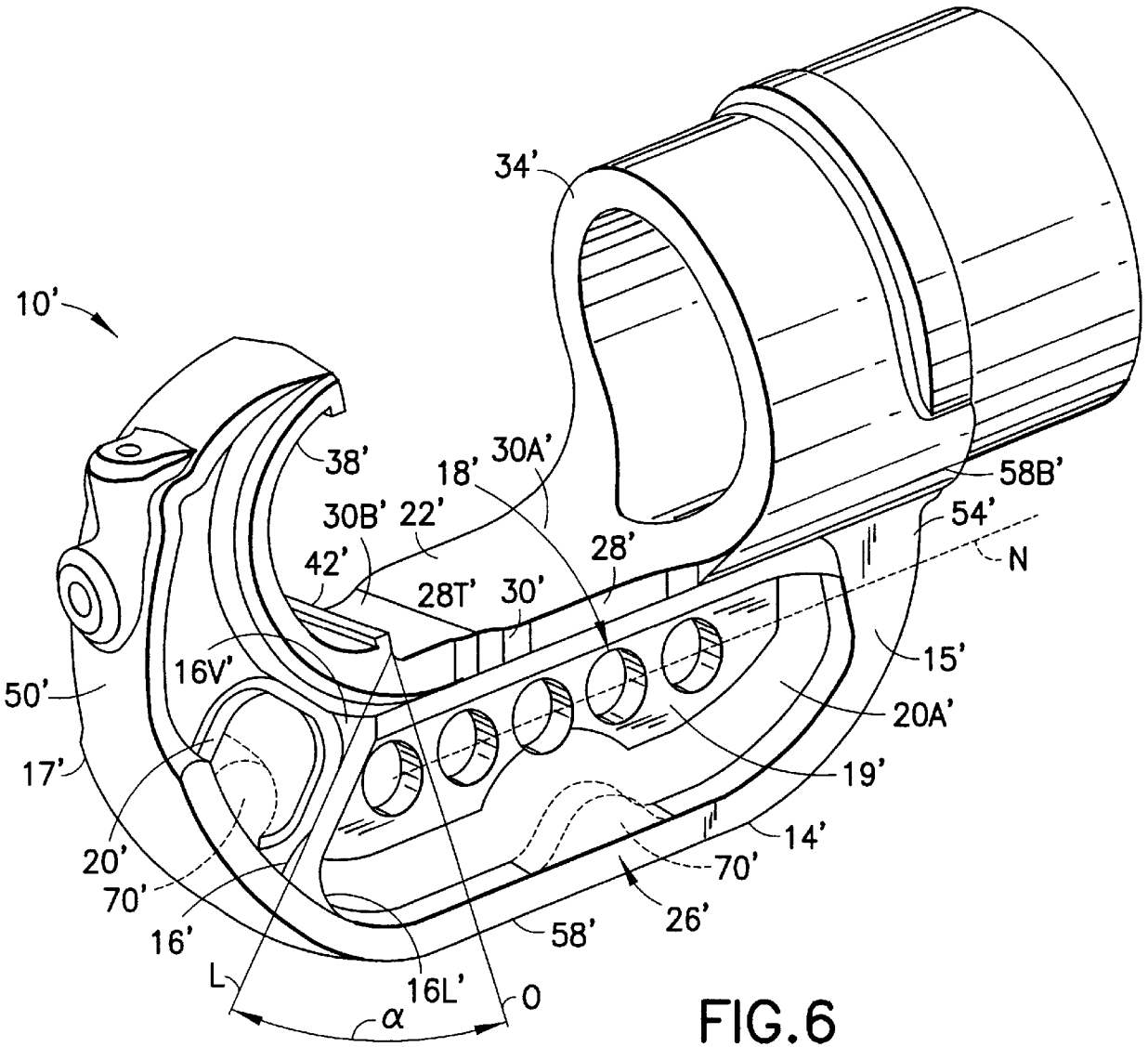
FIG. 6 is a perspective view of a crimping head body in accordance with still another alternative embodiment of the present invention.

Referring now to FIG. 6 there is shown a perspective view of a crimp head 10' for a crimping tool assembly (similar to tool assembly 12 in FIG. 1) in accordance with another alternative embodiment. Crimp head 10' shown in FIG. 6 is similar to the crimp head 10 described before and shown in FIGS. 1–5. Accordingly, similar features are similarly numbered. Crimp head 10' is a light-weight head, which has a general C shape. Head 10' has a central beam portion 26' connecting arm 50' at one end to arm 34' at the other end. Arm 50' is curved upon itself to form the static die holder/adapter 38'. The opposing arm 34" has a general collar shape in order to mate with the rest of the tool assembly (similar to tool assembly 12 in FIG. 1) and receive the end of the movable die (similar to die 24 in FIG. 1). As noted before, head 10' is a lightweight head and has weight reducing recesses 20', 20A' in the beam portion 26'. The recesses 20', 20A' extend inward from the lateral sides 15', 17' of the head 10' (see FIG.6). In this embodiment, the recesses 20', 21A' do not extend through the beam portion 26', although in alternate embodiments the weight reducing recesses may extend through from one lateral side to the other of the beam portion. As seen in FIG. 6., the recesses 20' 20A' in the beam portion 26' provide the beam portion 26' with a general I-beam cross-section. Accordingly, this beam portion 26' has opposed first and second flanges 30', 58', and a web 19' extending therebetween. In the embodiment shown in FIG. 6, the head 10' has an internal rib 16' which connects the first and second flanges 30', 58'.

The head 10' shown in FIG. 6 may be a one piece member formed by casting or forging. In the case where head 10' forged, one internal rib 16', located as shown in FIG. 6 and as will be described in greater detail below is used to provide the head 10' and in particular the beam portion 26' with desired rigidity and strength while maximizing the weight reduction over conventional crimping tool heads. In alternate embodiments, whether cast or forged, additional internal ribs (not shown) may be provided as desired (similar to the embodiments shown in FIGS. 1–4). Still referring to FIG. 6., the second or outer flange 58' extends on the outside of the head 10' from arm 50' to arm 34'. The flange 58' is radiused at one end to transition smoothly into the curved arm 50'. At the other end 54', the flange 58' is again curved to tie in to the exterior of arm 34'. The curvature of this portion of the flange may be as desired to achieve a suitable loading pattern along the flange. In this embodiment, the portion of the flange 58' at the end 54' has a tapering thickness which is widest at its base 58B'. The first or inner flange 30' may have a varying width along its length (extending between the end stop 42' of die holder 38' and arm 34'). In alternate embodiments, the flange may have a constant width. As seen in FIG. 6, the portion 30A' of the flange 30' proximate arm 34' is wider than portion 34B' proximate the curved arm 50'. Portion 30A' of flange 30' has lateral side flanges 28' which protrude outwards from sides 15', 17' of the beam portion 26'. The side flanges 28' extend outward past the side edges of the second flange 58'. The side flanges 28' may have transition portions 28T' which flares the flanges inward into flange portion 30B'. As has been described before in regards to a the embodiments in FIGS. 1–4, the inner flange 30' defines a guide surface 22' for the movable die (similar to movable die 24 in FIG. 1). As the movable die is moved toward the stationary die 38', the movable die interfaces with the guide surface 22' so that the die remains in one orientation and does not rotate relative to the head 10'. In this embodiment, the guide surface 22' extends to the stop 42' formed by the stationary die 38'.

During forging of head 10', a large draft angle, such as for example a draft angle of about 10° or more may be used in order to increase tool life and hence reduce cost of the head. In alternate embodiments, any suitable draft angle may be used when forging the tool head. The large draft angle causes the flanges 30', 58' to have a tapering thickness between the outer edges at sides 15', 17' and the flange root at the web 19'. In the case where the head is cast, the thickness of the flanges 30', 58' may be substantially constant. After forging, the head 10' may have fixturing ribs or projections 70' as shown in FIG. 6. The fixturing projections 70' provide locations on the head for a tooling fixture or jig to clamp and hold the head during the forming operation. FIG. 6 shows two projections 70' (the far side may have another two projections), for example purposes, and the head may be provided with any number of fixturing projections. The projections 70' may be removed, such as by machining, if desired (and thus are shown in phantom) after forging operations are finished. Along the neutral axis N of the beam portion 26', the web may have a series of through openings on holes 18'. The holes 18' may be round, or may have any other suitable shape such as for example an oblong slot with rounded ends, or an oval shape. FIG. 6 shows five holes 18' for example purposes, and in alternate embodiments the web of the beam portion may have any desired number of holes (or no holes) formed through the web. The through holes 18' may be formed by drilling or any other suitable forming process. Holes 18' are shown equally spaced, though in alternate embodiments the holes need not be equally spaced.

Internal rib 16' (in the embodiment the rib 16 is substantially bisected by web 19' into two portions on opposite sides of web 19') further ties the inner and outer 12 flanges 30', 58' to each other providing increased rigidity and strength to beam portion 26' and the head 10'. The internal rib 16' is oriented at angle $\alpha$ from an axis O normal to the guide surface 22' of the upper flange 30'. In the embodiment shown in FIG. 6, the angle $\alpha$ is between about 40° and 50°. In alternate embodiments, the angle of the rib may be any suitable angle. The line of action L of the rib 16' (which is substantially coincident with its axis of symmetry) intersects the guide surface 22' at the interface between the guide surface and stop 42' of the stationary die 38' (see FIG. 6). The internal rib 16' is joined at its upper end 16U' to the inner flange 30' at a location where the rib line of action L intersects the outside of the inner flange 30'. At the lower end 16L', the rib 16' is joined to the outer flange 58' at a location where the line of action L intersects the inner surface of the outer flange. The upper and lower ends 16U', 16L' of the rib 16' may be suitably radius or flared to provide a suitable transition for loads between the flanges and rib. As can be realized from FIG. 6, the internal ribs 16' thus tie the inner and outer flanges 30', 58' of the beam portion 26' in the region where the beam portion 26' interfaces with the static die 38'. This results in the beam "portion 26' and hence the head 10'" itself having generally similar rigidity and strength to a much heavier conventional head of a crimping tool which lacks the deep weight reducing scallops of head 10'.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A head for a crimping tool assembly, said head comprising:

a generally "C" shaped body which can withstand repeated tensile forces, said "C" shaped body comprising an elongated beam portion and a first arm extending in a given direction from a first end of said beam portion and a second arm extending in said given direction from an opposing end of said beam portion;

said beam portion having opposed first and second elongated sides, with the plane of the first and second sides extending generally parallel to said given direction, said beam portion including an inside elongated third side extending transversely of said given direction between said first and second sides, said beam portion including an outside elongated fourth side extending transversely of said given direction between said first and second sides, said third and fourth sides of the beam comprising continuous walls of a given thickness;

said beam portion having a plurality of internal supporting ribs which extend between said first and second sides transversely of said given direction, said ribs being connected at one end to said third side wall and at their opposing end to the fourth side wall, said ribs being pointed at said third side wall toward higher stress regions of said beam portion; and said beam portion having a plurality of openings or depressions in the first and second sides for reducing the weight of said beam portion, said openings or depressions being disposed in lower stress regions of said beam portion.

2. The head as in claim 1 wherein the third side wall of said beam portion includes a flat-faced guide surface for preventing rotational movement of a die holder of said tool assembly.

3. The head as in claim 2 wherein said beam portion has side flanges extending from said first and second sides, said flanges being located adjacent said flat-faced guide surface.

4. The head as in claim 3 wherein said flanges increase at least locally the width of the flat-faced guide surface.

5. The head as in claim 1 wherein said openings extend completely through said beam portion from said first side to said second side.

6. The head as in claim 1 wherein said depressions do not extend completely through said beam portion, however, complementary depressions extend inwardly from each of said first and second sides so as to leave a central wall between the depressions.

7. The head as in claim 1 wherein said first arm curves toward said second arm.

8. The head as in claim 1 wherein said second arm comprises a cylindrical bearing portion adapted to provide axial rigidity for a ram and movable die holder so that the ram does not bend or rotate during operation.

9. The head as in claim 1 wherein relief surfaces are provided in the flat-faced guide surface and the internal surface of the first arm to allow the crimp dies to fit without interference from the head.

10. The head as in claim 1 further including a die release button opening in said first arm of said body.

11. The head as in claim 1 wherein, at least one of said openings or depressions is arranged between adjacent ribs.

12. The head as in claim 1 wherein the central portion of the beam portion of the body is essentially straight and the end portions of the beam smoothly curve into the first and second arms.

13. A head for a crimping tool assembly, said head comprising:

a generally "C" shaped body which can withstand repeated tensile forces, said "C" shaped body comprising an elongated beam portion and a first arm extending in a given direction from a first end of said beam portion and a second arm extending in said given direction from an opposing end of said beam portion;

said beam portion having opposed first and second elongated sides, with the plane of the first and second sides extending generally parallel to said given direction, said beam portion including an inside elongated third side extending transversely of said given direction between said first and second sides, said beam portion including an outside elongated fourth side extending transversely of said given direction between said first and second sides, said third and fourth sides of the beam comprising continuous walls of a given thickness;

said beam portion having a plurality of internal supporting ribs which extend between said first and second sides transversely of said given direction, said ribs being connected at one end to said third side wall and at their opposing end to the fourth side wall, said ribs being pointed at said third side wall toward higher stress regions of said beam portion; wherein at least two ribs form a "V" shaped configuration with the vertex of the configuration ending at said third side wall at said region of high stress; and said beam portion having a plurality of openings or depressions in the first and second sides for reducing the weight of said beam portion, said openings or depressions being disposed in lower stress regions of said beam portion.

14. The head as in claim 13 wherein the vertex of the rib configuration is arranged adjacent the first arm of the body and wherein another rib is arranged canted toward said second arm and joins the third side wall adjacent the second arm.

15. A head for a crimping tool assembly, said head comprising:

a generally "C" shaped body which can withstand repeated tensile forces, said "C" shaped body comprising an elongated beam portion and a first arm extending in a given direction from a first end of said beam portion and a second arm extending in said given direction from an opposing end of said beam portion;

said beam portion having opposed first and second elongated sides, with the plane of the first and second sides extending generally parallel to said given direction, said beam portion including an inside elongated third side extending transversely of said given direction between said first and second sides, said beam portion including an outside elongated fourth side extending transversely of said given direction between said first and second sides, said third and fourth sides of the beam comprising continuous walls of a given thickness;

said beam portion having a plurality of internal supporting ribs which extend between said first and second sides transversely of said given direction, said ribs being connected at one end to said third side wall and at their opposing end to the fourth side wall, said ribs being pointed at said third side wall toward higher stress regions of said beam portion; wherein further including at least one projection extending from said fourth side wall, said at least one projection extending toward said third side wall in at least one of said openings or depressions, said at least one projection providing a clamping surface for holding the body during its manufacture; and said beam portion having a plurality of openings or depressions in the first and second sides for reducing the weight of said beam portion, said openings or depressions being disposed in lower stress regions of said beam portion.

16. The head as in claim 15 wherein there are at least two projections and the projections have a semicylindrical shape.

17. A crimping tool head for a crimping tool, the head comprising:

a frame having a general C shape, the frame being adapted to be coupled to a mating portion of the crimping tool, and comprising;

a proximal end portion located proximally to the mating portion of the crimping tool when the head is mated to the crimping tool;

a distal end portion; and an intermediate beam portion connecting the distal and proximal end portions, the beam portion having inner and outer flanges extending between the distal end portion and proximal end portion, wherein the beam portion defines a movable die guide surface for a movable die of the crimping tool, and has one internal rib joined to the inner flange at a location proximal to a distal end of the movable die guide surface.

18. The head as in claim 17, wherein the internal rib extends between the inner flange and the outer flange.

19. The head as in claim 17, wherein the frame is a one piece member that is forged or cast.

20. The head as in claim 17, wherein the beam portion has a web between the inner and outer flanges, the web having at least one through hole located on a neutral axis of the beam portion.

21. A crimping tool head for a crimping tool, the head comprising:

a frame having a general C shape, the frame being adapted to be coupled to a mating portion of the crimping tool, and comprising;

a proximal end portion located proximally to the mating portion of the crimping tool when the head is mated to the crimping tool;

a distal end portion; and an intermediate beam portion connecting the distal and proximal end portions, the beam portion having inner and outer flanges extending between the distal end portion and proximal end portion, wherein the beam portion defines a movable die guide surface for a movable die of the crimping tool, and has one internal rib joined to the inner flange at a location proximal to a distal end of the movable die guide surface and extending between the inner flange and the outer flange; and wherein the internal rib has a line of action, which is angled relative to an axis normal to the movable die guide surface.

22. The head as in claim 21, wherein the angle is between about 400 and 500.

23. The head as in claim 21, wherein the distal end of the movable die guide surface is adjacent a die stop surface for stopping the movable die, the stop surface being formed by the distal end portion, and wherein the line of action of the internal rib extends through an intersection of the distal end of the movable die guide surface and die stop surface.

* * * * *